US011122886B1

(12) United States Patent
Conway et al.

(10) Patent No.: US 11,122,886 B1
(45) Date of Patent: Sep. 21, 2021

(54) ADJUSTABLE TABLE APPARATUS AND METHOD

(71) Applicant: Halcon Corp., Stewartville, MN (US)

(72) Inventors: Benjamin Saintmane Conway, Rochester, MN (US); Brady John Niebolte, St. Charles, MN (US); Jacob Edward Snowbarger, Rochester, MN (US)

(73) Assignee: Halcon Corp., Stewartville, MN (US)

( * ) Notice: Subject to any disclaimer, the term of this patent is extended or adjusted under 35 U.S.C. 154(b) by 0 days.

(21) Appl. No.: 15/930,860

(22) Filed: May 13, 2020

(51) Int. Cl.
*A47B 3/083* (2006.01)
*A47B 13/08* (2006.01)

(52) U.S. Cl.
CPC ..... *A47B 3/083* (2013.01); *A47B 13/081* (2013.01); *A47B 2003/0835* (2013.01); *A47B 2200/0037* (2013.01)

(58) Field of Classification Search
CPC ..... A47B 3/083; A47B 2003/0835; A47B 2200/0037
USPC ..... 108/115, 50.01
See application file for complete search history.

(56) References Cited

U.S. PATENT DOCUMENTS

| | | | | |
|---|---|---|---|---|
| 1,668,282 | A | 5/1928 | Moore et al. | |
| 2,596,663 | A | 5/1952 | Duffy | |
| 2,836,475 | A | 5/1958 | Sapp | |
| 2,860,020 | A | 11/1958 | Nickliss et al. | |
| 3,188,158 | A | 6/1965 | Sanchez | |
| 3,342,147 | A | 9/1967 | Shettles et al. | |
| 3,558,152 | A | 1/1971 | Miles | |
| 3,561,376 | A | 2/1971 | Knoblock | |
| 3,805,710 | A | 4/1974 | Leshem | |
| 4,099,469 | A | 7/1978 | Sahli | |
| 4,150,630 | A | 4/1979 | Pokorny et al. | |
| 4,502,393 | A | 3/1985 | Kaiser | |
| 4,915,034 | A | 4/1990 | Grabe et al. | |
| 5,005,848 | A | 4/1991 | Cornell | |
| 5,109,778 | A | 5/1992 | Berkowitz et al. | |
| 5,121,697 | A | 6/1992 | Baum et al. | |
| 5,182,996 | A | 2/1993 | Gutgsell | |
| 5,205,223 | A | 4/1993 | Ball et al. | |
| 5,337,657 | A | 8/1994 | Diffrient | |
| 5,398,620 | A | 3/1995 | Rouch | |
| 5,562,052 | A | 10/1996 | Glashouwer et al. | |
| 5,638,761 | A | 6/1997 | Berkowitz et al. | |
| 5,927,214 | A | 7/1999 | Schwartz et al. | |
| 6,041,721 | A | 3/2000 | Weston | |
| 6,062,147 | A * | 5/2000 | Footitt | A47B 17/00 108/50.01 |
| 6,082,838 | A | 7/2000 | Bissu-Palombo | |

(Continued)

FOREIGN PATENT DOCUMENTS

| | | |
|---|---|---|
| CH | 240961 | 2/1946 |
| DE | 35067 | 9/1885 |

(Continued)

OTHER PUBLICATIONS

Clarin, "Fast Brake Nesting Table," 2011, retrieved from URL <http://www.clarinseating.com/literature/Fast%20Brake%20small.pdf>, 2 pages.

*Primary Examiner* — Jose V Chen
(74) *Attorney, Agent, or Firm* — Fish & Richardson P.C.

(57) ABSTRACT

An adjustable table apparatus and related method can include a table configured to adjust between an operative position and a collapsed position.

21 Claims, 5 Drawing Sheets

(56) References Cited

U.S. PATENT DOCUMENTS 6,164,217 A 12/2000 Prendergast
6,170,407 B1 1/2001 Hayward
6,202,567 B1 * 3/2001 Funk ..... A47B 21/06 108/50.01
6,314,892 B1 11/2001 Favini
6,336,414 B1 1/2002 Stewart et al.
6,637,352 B1 10/2003 Thode et al.
6,647,900 B1 11/2003 Kopish
6,845,723 B2 * 1/2005 Kottman ..... A47B 3/00 108/115
6,935,247 B2 * 8/2005 Schaefers ..... A47B 21/00 108/50.01
6,997,115 B2 * 2/2006 Lockwood ..... A47B 3/0803 108/115
7,066,098 B2 6/2006 Blasen et al.
7,634,968 B2 12/2009 Cornelius
7,765,938 B2 8/2010 Piretti
7,878,128 B2 2/2011 Watson et al.
7,975,625 B2 * 7/2011 Topham ..... A47B 3/0803 108/115
8,069,795 B1 12/2011 Williams et al.
8,359,983 B2 1/2013 Williamson et al.
8,381,664 B2 * 2/2013 Prendergast ..... A47B 3/00 108/115
9,667,115 B2 5/2017 Sturm et al.
9,950,728 B2 * 4/2018 Weiser ..... A47B 13/021
2004/0094075 A1 * 5/2004 Norstad ..... A47F 5/13 108/115
2007/0137534 A1 6/2007 Dhanoa et al.
2007/0209559 A1 * 9/2007 Mockel ..... A47B 3/0803 108/115
2007/0261611 A1 * 11/2007 Kumazawa ..... A47B 3/0815 108/115
2008/0017083 A1 * 1/2008 VanNimwegen .... A47B 3/0803 108/121
2008/0210144 A1 * 9/2008 Prendergast ..... A47B 87/002 108/116
2009/0114130 A1 5/2009 Chirea et al.
2009/0283020 A1 * 11/2009 Hsu ..... A47B 3/0815 108/115
2010/0258042 A1 * 10/2010 Rutz ..... A47B 3/0818 108/115
2011/0139042 A1 * 6/2011 Korb ..... A47B 3/00 108/115
2013/0284076 A1 * 10/2013 Okuda ..... A47B 3/0818 108/115

FOREIGN PATENT DOCUMENTS

DE 2321750 11/1973
EP 0613637 9/1994

* cited by examiner

ADJUSTABLE TABLE APPARATUS AND METHOD

TECHNICAL FIELD

This disclosure relates to an adjustable table apparatus and method, including for example a table apparatus that is adjustable from an operative position to a collapsed position.

BACKGROUND

Adjustable table are often used in flexible spaces in a manner that allows the space to be customized according to a user's needs. For example, adjustable tables can be deployed in a first arrangement in a flexible office space to serve as a conference setting, and then such tables can be adjusted to a second position for transport and storage so that the flexible office space is customized to a different configuration. Some prior art table systems employ a collapsible table in which the legs of the table can be adjusted from an upright orientation (e.g., for use when the table is deployed) to collapsed position in which the table legs are folded toward a lower surface of the table. In such circumstances, each collapsible table can be adjusted to the collapsed position and manually carried away for storage. Other prior art table systems employ a flip top table in which the tabletop surface can be adjusted from a generally horizontal orientation (e.g., for use when the table is deployed) to a generally vertical orientation (e.g., for use when the table is being stored). In some flip top table systems, the table legs are cylindrical tubes extending toward the ground surface that are movable relative to one another prior to adjusting the tabletop surface to the generally vertical orientation. Other flip top table systems employ table legs that rest on the ground surface and are maintained in the same fixed position relative to one another both when the tabletop surface is in the generally horizontal orientation and in the generally vertical orientation.

SUMMARY

Some embodiments of an adjustable table apparatus can include a table configured to adjust between an operative position and a collapsed position while safely maintaining the balance of the table during such adjustment and during transport. In particular versions, the table can be equipped with movable fascia members along an underside of the tabletop. Such movable fascia members may be arranged in a first orientation to enhance an aesthetic and sleek appearance of the table (while in the operative position) and can readily shift to a second orientation in response to movement of a corresponding one of the table legs (during adjustment of the table to the collapsed position). In particular embodiments, the adjustable table apparatus can be equipped with at least two movable legs that extend to the ground surface and are configured to swing outwardly away from one another (during adjustment of the table to the collapsed position). Each of the movable legs may include a swing arm having a multiple-bend configuration in a plane parallel to the tabletop surface (in the operative position), which can facilitate interaction with the movable fascia, can improve symmetry and positioning of the table legs when the table is in the operative position, can achieve an offset position of the table legs to desirably maintain the balance of the table apparatus when the table is adjusted to the collapsed position, or a combination thereof.

Various embodiments described herein include an adjustable table apparatus. The apparatus may comprise a tabletop including an upper surface and a lower surface, and the tabletop can be movable about a tabletop hinge axis such that the upper surface of the tabletop extends in a horizontal orientation when the table apparatus is in an operative position and the upper surface of the tabletop extends in a vertical orientation when the table apparatus is in a collapsed position. The apparatus may also comprise a pair of fixed legs mounted in a fixed position relative to the tabletop hinge axis, and the pair of fixed legs can be configured to extend to a ground surface for supporting the tabletop. The apparatus may further comprise a first movable leg that is pivotable about a first vertical axis relative to both the tabletop and the fixed legs and that includes a first vertical leg portion configured to extend to the ground surface for supporting the tabletop. Optionally, the first movable leg can include a first horizontal dual-bend swing arm extending in a horizontal plane from the first vertical axis to the first vertical leg portion. The apparatus may also include a second movable leg that is pivotable about a second vertical axis relative to both the tabletop and the fixed legs and that includes a second vertical leg portion configured to extend to the ground surface for supporting the tabletop. The second movable leg can optionally include a second horizontal dual-bend swing arm extending in a horizontal plane from the second vertical axis to the second vertical leg portion.

Other embodiments of an adjustable table apparatus are also described herein. The table apparatus may include a tabletop having an upper surface and a lower surface, and the tabletop can be pivotable about a horizontal axis such that the upper surface of the tabletop extends in a horizontal orientation when the table apparatus is in an operative position and the upper surface of the tabletop extends in a vertical orientation when the table apparatus in a collapsed position. The table apparatus may also include first and second fixed legs arranged in a fixed position relative to the horizontal axis and configured to support the tabletop over a floor surface. The table apparatus may further include a first adjustable leg that is movable about a first vertical axis relative to the first and second fixed legs. The first adjustable leg can include a first distal arm segment spaced apart from the first vertical axis, and the first distal arm segment has a first longitudinal axis extending in a horizontal plane. The first adjustable leg can also include a first vertical leg portion joined with the first distal arm, and first vertical leg portion can be configured to extend vertically toward the floor surface. Optionally, the first longitudinal axis of the first distal arm may extend parallel to the horizontal axis when the tabletop is in the vertical orientation. The table apparatus may further include a second adjustable leg that is movable about a second vertical axis relative to the first and second fixed legs. The second adjustable leg may include a second distal arm segment spaced apart from the second vertical axis, and the second distal arm segment may have a second longitudinal axis extending in the horizontal plane. The second adjustable leg may also include a second vertical leg portion joined with the second distal arm, and the second vertical leg portion can be configured to extend vertically toward the floor surface. Optionally, the second longitudinal axis of the second distal arm may extend parallel to the horizontal axis when the tabletop is in the vertical orientation.

Some embodiments described herein provide a method that includes pivoting a first movable leg of an adjustable table apparatus about a first vertical axis away from a second movable leg while a tabletop of the adjustable table apparatus extends in a horizontal orientation. The method may optionally include, in response to said pivoting the first movable leg, shifting a first movable fascia hingedly mounted to the lower surface of the tabletop from a displayed orientation to a collapsed orientation. Also, the method may include pivoting the second movable leg about a second vertical axis away from the first movable leg. The method may optionally include, in response to said pivoting the second movable leg, shifting a second movable fascia hingedly mounted to the lower surface of the tabletop from a displayed orientation to a collapsed orientation. Further, the method may include, after shifting the optional first and second movable fascia, pivoting the tabletop about a horizontal hinge axis so that an upper surface of the tabletop moves to a vertical orientation and a pair of fixed vertical leg portions of the adjustable table apparatus is positioned on a first side of the tabletop while first and second vertical leg portions of the first and second movable legs are positioned on a second side of the tabletop opposite from the first side of the tabletop.

These and other embodiments described herein may optionally provide one or more of the following benefits. First, some embodiments of the adjustable table apparatus can be configured to readily and safely shift between operative and collapsed positions by a single user during rearrangement, for example, in a flexible space. As such, the user can individually shift each of the movable legs of the adjustable table apparatus and also shift the orientation of the tabletop for use as a table (in the operative position) or for simplified transport and storage (in the collapsed position).

Second, some embodiments of the table apparatus described herein may provide an arrangement of table legs and fascia along the underside of the tabletop to achieve a selective aesthetic appearance suitable, for example, as a formal conference table. In particular embodiments, the optional fascia members can be oriented to provide a selected sleek appearance while advantageously concealing some mechanical components of the table apparatus and avoiding interference with users' legs during use, and some or all of the fascia members can be movable relative to the tabletop to provide clearance for the swing arms of the movable table legs during adjustment of the table apparatus to the collapsed position.

Third, some embodiments of the table apparatus can employ the movable legs having a dual-bend configuration in a plane parallel to the ground surface, which optionally provides beneficial functions during use of the table. For example, the shape and structure of the movable legs can be configured to abut with a corresponding one of the movable fascia members to thereby drive the movement of the fascia member during adjusted of the table apparatus. Also, the shape and structure of the movable leg can improve symmetry and positioning of the viewable portions of the movable legs that extend to the ground surface. Additionally, the shape and structure of the movable legs can be configured in a manner that positions a first pair of feet on a first side of the tabletop and a second pair of feet on a second side of the tabletop while the table apparatus is in the collapsed position, thereby achieving a safe balance of the table apparatus during transport or storage.

Fourth, some embodiments of the table can be particular suited for nesting with other tables when in the collapsed position. For example, the movable legs of the table apparatus can be swung to an outer position (when the table is in the collapsed position) to provide sufficient clearance for the fixed legs of another neighboring table when such tables are nested together during storage.

The details of one or more embodiments are set forth in the accompanying drawings and the description below. Other features, objects, and advantages will be apparent from the following description and drawings, and from the claims.

DETAILED DESCRIPTION OF ILLUSTRATIVE EMBODIMENTS

Figure 1A:
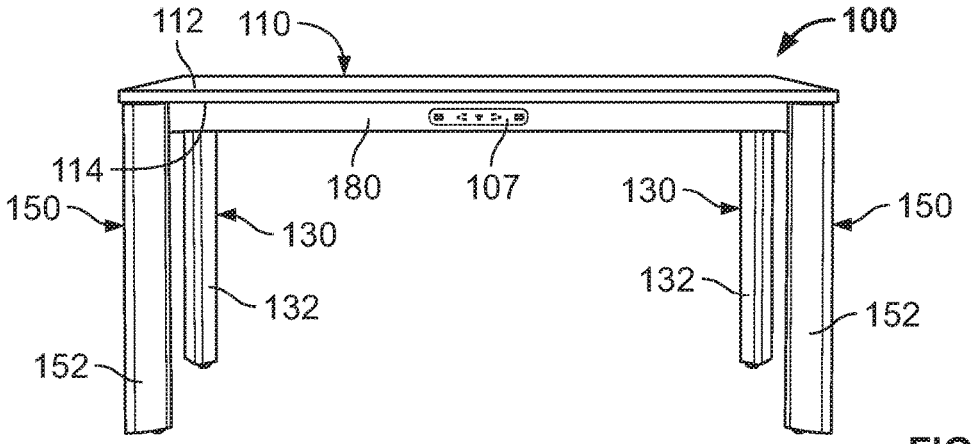
FIG. 1A is a perspective view of an adjustable table apparatus in an operative position, in accordance with particular embodiments.
Figure 1B:
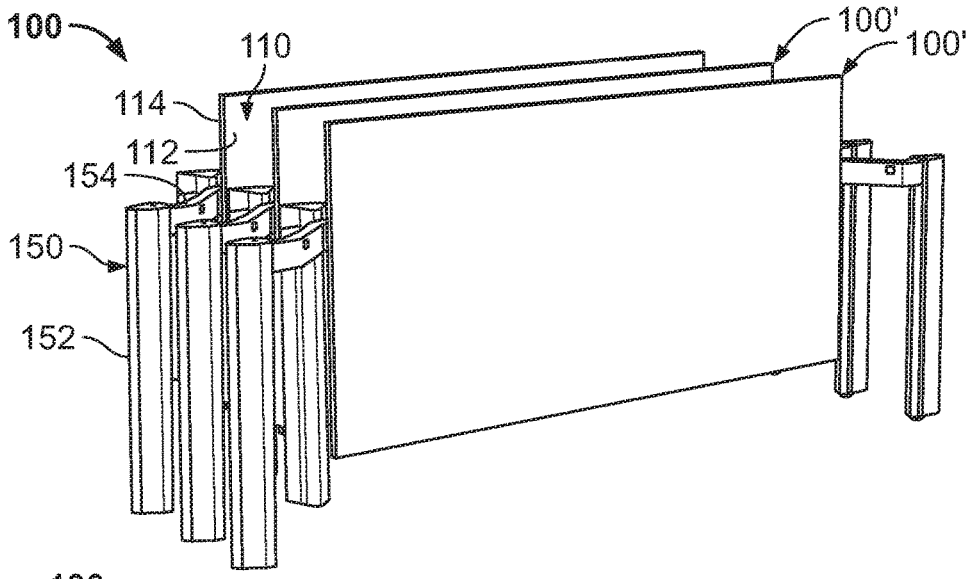
FIG. 1B is a perspective view of the adjustable table apparatus of FIG. 1A adjusted to a collapsed position.
Figure 1C:
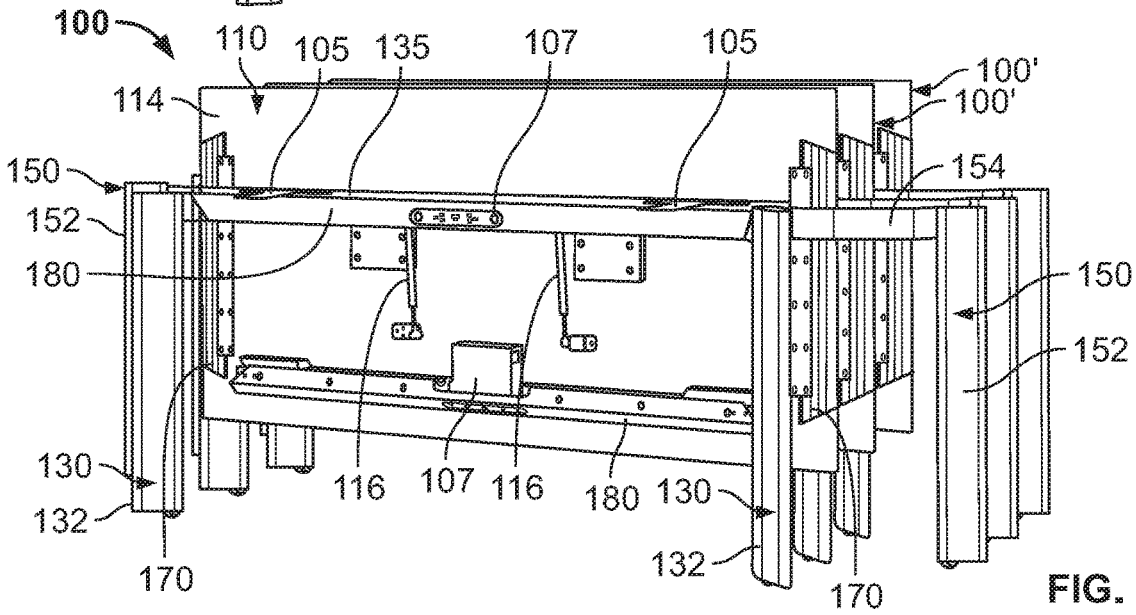
FIG. 1C is another perspective view of the adjustable table apparatus of FIG. 1A adjusted to the collapsed position.

Referring now to FIGS. 1A-C, an adjustable table apparatus 100 can be configured to shift from an operative position (FIG. 1A) to a collapsed position, which may be suitable for transport or storage (FIGS. 1B-C). In particular implementations, the table apparatus 100 is configured to nest with one or more adjacent table apparatuses 100' when arranged in the collapsed position, as shown for example in FIGS. 1B-1C. The table apparatus 100 can be equipped with a tabletop 110, one or more fixed legs 130, and one or more movable legs 150. The tabletop 110 includes an upper surface 112 and a lower surface 114, and the tabletop 110 is configured to be adjusted by a user from a horizontal orientation (e.g., in which the upper surface 112 is generally level with the floor) when the table apparatus 100 is in the operative position (FIG. 1A) to a vertical orientation (e.g., in which the upper surface 112 is generally perpendicular to the floor) when the table apparatus 100 is in a collapsed position (FIGS. 1B-1C).

In this embodiment, the table apparatus 100 includes a pair of fixed legs 130 and a pair of movable legs 150. The fixed legs 130 are mounted in a fixed position relative to the tabletop hinge axis 115 (refer FIGS. 2A-B), and in this embodiment, are connected to one another via a support beam 135 (FIG. 1C). The fixed legs 130 include fixed vertical leg portions 132 that are configured to extend toward the floor, thereby providing mechanical support for the tabletop 110 when the table apparatus 100 is in the operative position (FIG. 1A). As described in more detail below, each movable leg 150 is pivotable about a corresponding vertical axis 155 (refer to FIG. 2A) so that the movable leg 150 can be pivoted outwardly away from the opposing movable leg 150. Also, in this embodiment, each movable leg 150 includes a vertical leg portion 152 and a multiple-bend swing arm 154, which (as detailed below) may optionally extend in a horizontal plane from the vertical axis to connect with the respective vertical leg portion 152 of the movable leg 150.

Figure 3C:
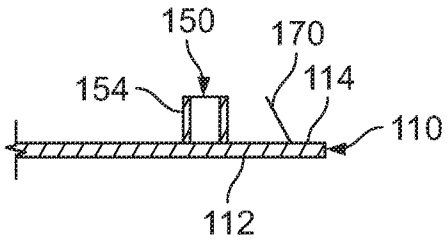
FIG. 3C is a cross-sectional view of the adjustable table apparatus of FIG. 3A, with some components removed from view.
Figure 3D:
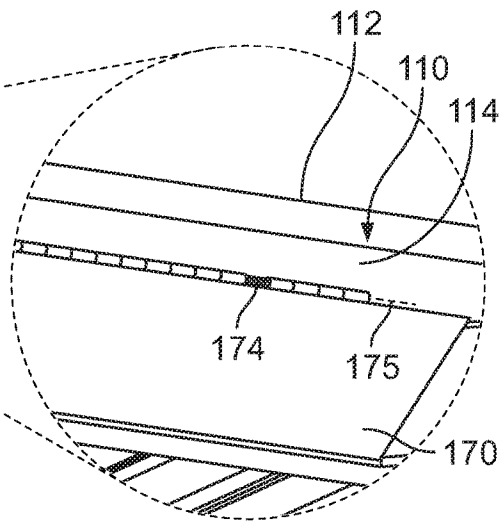
FIG. 3D is a perspective view of a selected portion of the adjustable table apparatus of FIG. 3B.
Figure 3A:
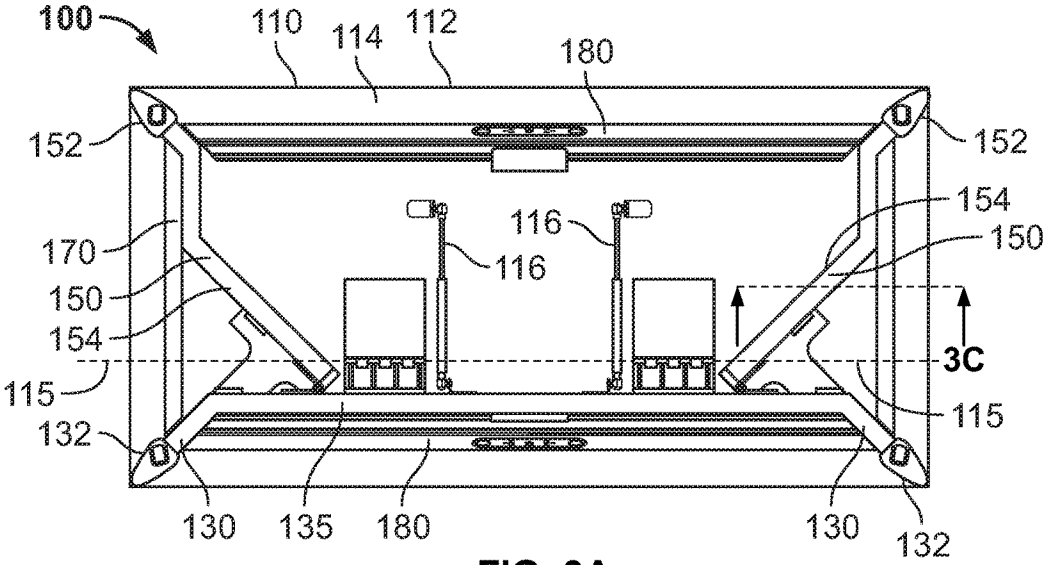
FIG. 3A is a bottom view of the adjustable table apparatus of FIG. 1A (having some components remove from view for illustrative purposes), with the tabletop in a generally horizontal orientation.
Figure 3B:
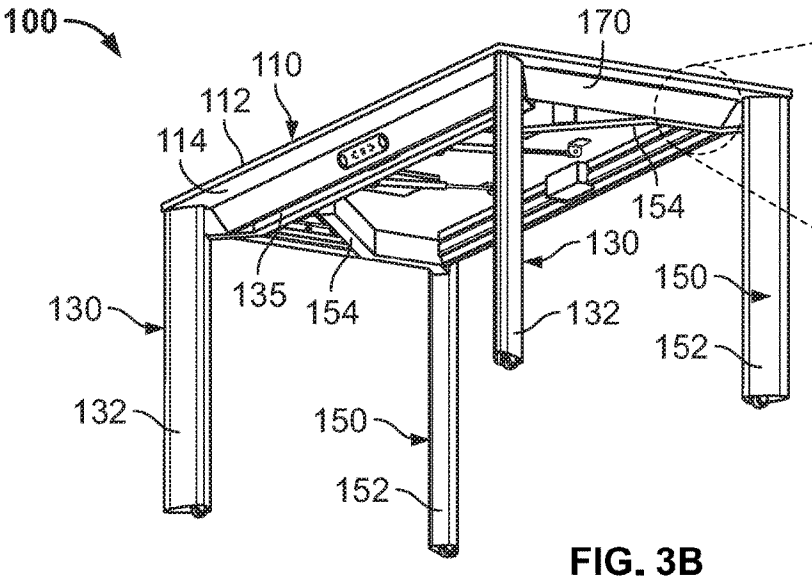
FIG. 3B is a perspective view of the adjustable table apparatus of FIG. 3A.

Still referring to FIGS. 1A-C, the table apparatus 100 may include movable fascia 170 that are movably mounted relative to an underside of the tabletop 110 and are configured to shift between a collapsed orientation (e.g., refer to FIGS. 1C and 5B) and a displayed orientation (e.g., refer to FIG. 3B). For example, the movable fascia 170 can be hingedly mounted along the lower surface 114 of the tabletop 110, an each movable fascia 170 can be adjusted from the displayed orientation to the collapsed orientation in response to a pivoting motion of the adjacent movable leg 150 outwardly away from the other movable leg 150. Additionally, the table apparatus may optionally include at least one fixed fascia 180 that do not shift to collapsed orientations. For example a first fixed fascia 180 can be fixedly mounted relative to the underside of the tabletop 110. A second fixed fascia 180 can be mounted to, or integral with, the support beam 135 extending between the fixed legs 130. Optionally, the fixed fascia 180 can include electrical connection sockets 107 mounted thereto. When the table apparatus 100 is in its operative position, the outwardly facing surfaces of the movable fascia 170 and the fixed fascia 180 are displayed in an orientation below the lower surface 114 of the tabletop 110 to provide a selective aesthetic appearance and to at least partially conceal from (upper or side views) other components of the table apparatus 100 arranged between the fascia 170 and 180 along the underside of the tabletop 110.

In some optional embodiments, the movable fascia 170 each have a length that is different from the length of the fixed fascia 180, and as shown for example in FIGS. 1A and 3A-D, the movable fascia 170 and the fixed fascia 180 can have the same profile and angular relationship (relative to the lower surface 114 of the tabletop 110) when arranged in the displayed orientation so as to provide a selected aesthetic appearance that is similarly presented along all sides of the table apparatus 100. Additionally, in some optional embodiments, the vertical portions 132 of the fixed legs 130 and the vertical portions 152 of the movable legs 150 can have the same non-circular shape in a horizontal cross-section, which can also provide a selective aesthetic appearance that is similar presented along all sides of the table apparatus 100 is in the operative position. For example, as shown is FIGS. 1A-C and FIGS. 3A-B, the vertical portions 132 of the fixed legs 130 and the vertical portions 152 of the movable legs 150 can have a rounded isosceles triangular form in a horizontal cross-section, in which the smaller rounded end is oriented outwardly toward the respective corner of the tabletop 110 when the table apparatus 100 is in the operative position (and in which the larger, flatter end of the cross-section shape is opposite from the smaller rounded end).

Still referring to FIGS. 1A-C, the adjustable table apparatus 100 can be configured to safely shift between the operative position (FIG. 1A) and the collapsed position (FIGS. 1B-1C) by a single user during rearrangement. As described in more detail below in connection with 3A-7B, the single user can individually shift a first movable leg 150 outwardly away from the other movable leg 150 while the tabletop 110 remains in its horizontal orientation and is supported by three legs (the fixed legs 130 and the other movable leg 150). By pivoting the first movable leg 150, the movable fascia 170 adjacent to the first movable leg 150 can automatically adjust to its collapsed orientation without manual manipulation by the user. Similarly, the single user can individually shift the second movable leg 150 outwardly away from the first movable leg 150. In doing so, the tabletop 110 may slowly begin to pivot away from its horizontal position while under the control of (optional) gas pistons 116 that dampen the lowering movement of the tabletop. Optionally, the single user may advantageously use a single arm/hand to individually shift the second movable leg 150 outwardly away from the first movable leg 150 while using a second hand/arm to grip the tabletop 110, thereby further controlling the lower of the tabletop 110 from its horizontal orientation to its vertical orientation. Again, by pivoting the second movable leg 150, the movable fascia 170 adjacent to the second movable leg 150 can automatically adjust to its collapsed orientation without manual manipulation by the user. After the single user has shifted the movable legs 150 outwardly away from one another and the tabletop 110 is adjusted from its horizontal orientation to its vertical orientation, the fixed legs 130 and the movable legs 150 can be advantageously arranged to provide stability and balance for the tabletop 110 while the user is transporting or storing the table apparatus 110. For example, when the table apparatus is in the collapsed position, the multiple-bend swing arm 154 (e.g., a dual-bend swing arm 154 in the depicted embodiment) of each movable leg 150 arranges the vertical leg portions 152 to be positioned on one side of the tabletop 110 (e.g., forward of the upper surface 112) while fixed vertical leg portions 132 of the fixed legs 130 are positioned on an opposite side of the tabletop 110 (e.g., rearward of the lower surface 114). That way, the center of mass of the tabletop 110 (and in this case, the mass centroid of the table apparatus 100) is positioned between the four legs 130, 150 extending to the floor. Finally, the single user can optionally position the table apparatus 100 (when in the collapsed position) in a nested arrangement with other similar table apparatuses 100' (FIGS. 1B-1C). For example, the movable legs 150 of the table apparatus 100 can be swung to their respective outer positions (when the table apparatus 100 is in the collapsed position) to provide sufficient clearance for the fixed legs of another neighboring table apparatus 100' when such table apparatuses 100, 100' are nested together during storage. Optionally, each table apparatus 100 can be equipped with one or more buffers 105, which can serve as spacers to prevent the fixed legs 130 of the table apparatus 100 from contacting (and possibly damaging) an upper surface of a tabletop of an adjacent table apparatus 100' in the nested configuration.

Figure 2A:
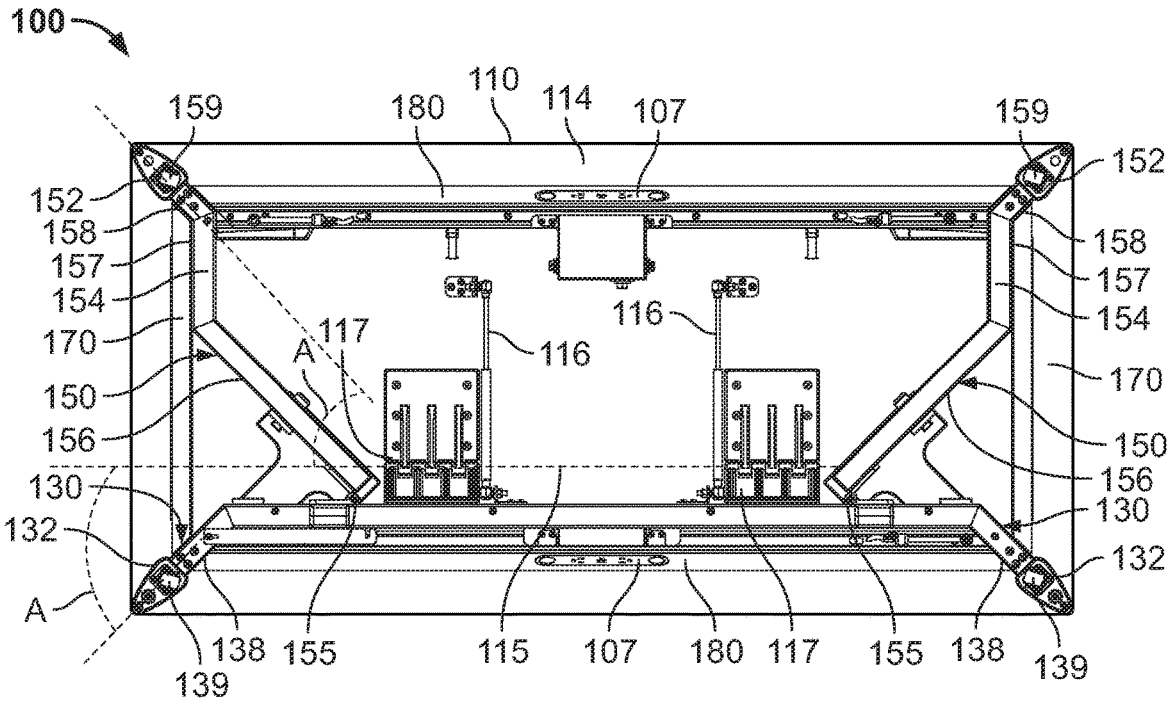
FIG. 2A is a bottom view of the adjustable table apparatus of FIG. 1A in the operative position.
Figure 2B:
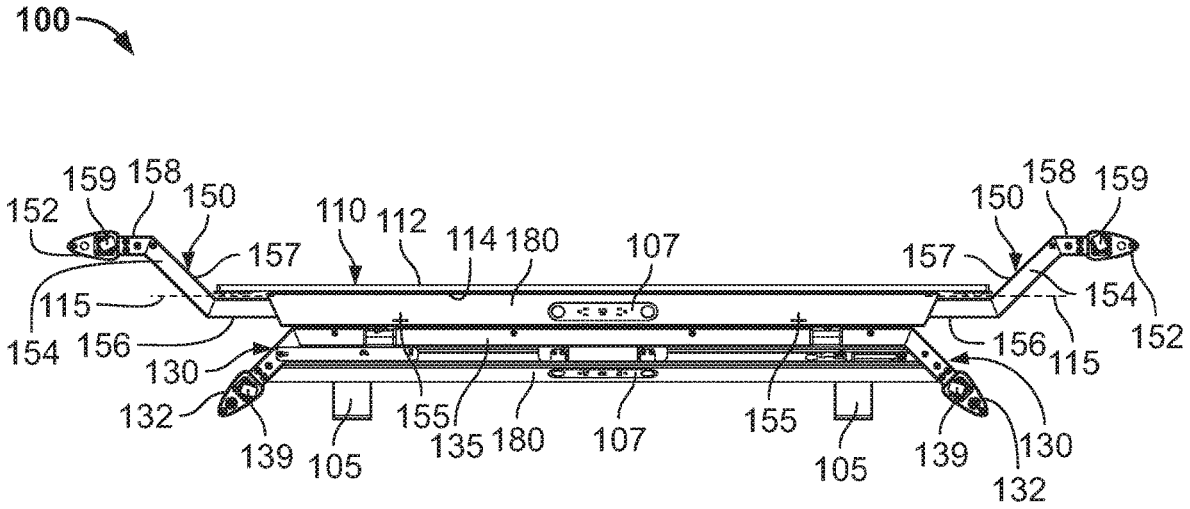
FIG. 2B is a bottom view of the adjustable table apparatus of FIG. 2A adjusted to the storage position.

Referring now to FIGS. 2A-B, the movable legs 150 can be shifted from a first position (FIG. 2A) to a second position (FIG. 2B) so as to provide clearance for the tabletop 110 to adjust from the operative position to the collapsed position. As previously described, each movable leg 150 can be pivoted about its corresponding vertical axis 155, which is this embodiment is defined by a hinged connection between the movable leg 150 and the support beam 135. The action of pivoting the each movable leg 150 outwardly away from the first position (FIG. 2A) to the second position (FIG. 2B) causes the swing arm 154 to move in a horizontal plane (e.g., a plane that, in this embodiment, extends parallel to the tabletop hinge axis 115) and thereby engage the adjacent fascia 170 and drive the movable fascia 170 to its collapsed orientation along the underside of the tabletop 110.

After the movable legs 150 are adjusted to the second position, the tabletop 110 can be shifted from the operative position (FIG. 2A) to the collapsed position (FIG. 2B) by pivoting the tabletop 110 about the table top hinge axis 115. In this embodiment, the tabletop hinge axis 115 is defined by a two hinge assemblies 117 mounted to the lower side 114 of the tabletop 110 and the support beam 135. As previously described, one or more gas pistons 116 can be optionally employed (e.g., mounted proximate to the hinge assemblies 117 in this embodiment) to dampen the movement of the tabletop 110 between the operative position and the collapsed position. Optionally, the lower ends of the vertical leg portions 132 of the fixed legs 130 can be equipped with lockable rollers 139, and the lower ends of the vertical leg portions 152 of the movable legs 150 can be equipped with lockable rollers 159, all of which can facilitate transport of the table apparatus along the ground surface.

Referring to FIG. 2B, wherein the tabletop 110 is arranged in the collapsed position such that the upper surface 112 of the table top extends in a vertical orientation (refer also to FIGS. 1B-1C), the pair of fixed legs 130 are positioned on a first side of a vertical plane along the upper surface 112 of the tabletop 110 while the pair of vertical leg portions 152 of the movable legs 150 remain on a second (opposite) side of the vertical plane along the upper surface 112 of the table top 110. As such, when the tabletop 110 is shifted to the collapsed position (FIG. 2B), the table apparatus 100 can safely maintain its center of mass between the four vertical leg portions 152 and 132 that extend to the ground, thereby permitting a user to readily transport or store the table apparatus 100 in the collapsed position while reducing the likelihood of inadvertently tipping or unbalancing the table apparatus 100.

In the depicted embodiment of FIGS. 2A-2B, such benefits can be achieved by maintaining the tabletop hinge axis 115 in a relative location between the vertical leg portions 132 of the fixed legs 130 and the pair of vertical leg portions 152 of the movable legs 150 both when the table apparatus 100 is in the operative position (FIG. 2A) and the collapsed position (FIG. 2B). For example, in both positions depicted in FIGS. 2A-2B, the vertical leg portions 132 of the pair of fixed legs 130 are positioned on a first side of a vertical plane extending through the tabletop hinge axis 115 while the vertical leg portions 152 of the pair of movable legs 150 consistently remain on a second (opposite) side of the vertical plane extending through the tabletop hinge axis 115. As described above, each movable leg 150 can include the swing arm 154 with multiple bends along its length in the horizontal plane, which operate to maintain the vertical leg portion 152 of the movable leg 150 on its corresponding side of the vertical plane through the tabletop hinge axis 115 throughout all parts of its movement path (when transitioning between the operative position and the collapsed position). For example, in the embodiment depicted in FIGS. 2A-B, the swing arm 154 of each movable leg 150 includes a dual-bend configuration providing the shape and structure to act upon the adjacent movable fascia 170 (described above), the shape and structure to provide the desired orientation and aesthetic appearance for the vertical leg portion 152 (including providing a symmetric orientation relative to the vertical leg portion 132 of the neighboring fixed leg 130), and the shape and structure to maintain the adjoining vertical leg portion 152 on the second side of the vertical plane through the tabletop hinge axis 115 throughout all parts of its movement path (while the vertical leg portion 132 of the neighboring fixed leg 130 remains on the first side of the vertical plane).

Referring again to FIG. 2A, the multiple-bend swing arm 154 of each movable leg 150 can extend longitudinally in a horizontal plane between the vertical axis 155 of the movable leg 150 and the vertical leg portion 152. For example, the swing arm 154 in this embodiment is depicted as horizontal dual-bend swing arm. Such a dual-bend swing arm 154 can include a first arm segment 156 extending longitudinally in the horizontal plane (e.g., a plane perpendicular to the vertical leg portion 152) away from its corresponding vertical axis 155 and toward a first bend in the horizontal plane. The swing arm 154 also includes a second arm segment 157 that extends longitudinally in the horizontal plane away from the first bend and toward a second bend in the horizontal plane. In this embodiment, the first bend directs the length of the swing arm 154 to transition in a direction toward a long edge of the tabletop 110 depicted in FIG. 2A, and the second arm segment 157 then extends longitudinally in a direction perpendicular to the long edge of the tabletop 110 (and parallel to a short edge of the tabletop 110 in this embodiment). As shown in FIG. 2A, the second arm segment 157 extends behind (and adjacent to) the movable fascia 170 in a direction that is parallel to a hinged fascia axis 175 (refer to FIG. 3D). The swing arm 154 also includes a third arm segment 158 extending longitudinally in the horizontal plane away from the second bend and toward the adjoining vertical leg portion 152 (which extends vertically toward the ground surface). In this embodiment, the second bend directs the length of the swing arm 154 to transition in a direction toward a corresponding corner of the tabletop 110 depicted in FIG. 2A such that the third arm segment 158 then extends longitudinally in a direction toward the corner (and, as detailed below, at an angle "A" relative to the tabletop hinge axis 115 that is mirrored by the fixed arm segment 138 of the neighboring fixed leg 130 depicted in FIG. 2A). As described in more detail below, some implementations of the multiple-bend swing arm 154 can be configured such that each of the first arm segment 156, the second arm segment 157, and the third arm segment 158 can contact the adjacent movable fascia 170 during the pivoting motion of the movable leg 150 about its respective vertical axis 155.

Still referring to FIG. 2A, each of the fixed legs 130 may optionally include a fixed horizontal arm 138 extending from the support beam 135 in a direction generally away from the tabletop hinge axis 115. The fixed horizontal arm 138 extends longitudinally in the horizontal plane to the adjoining fixed vertical leg portion 132 of the fixed leg 130. The fixed horizontal arm 138 may have a longitudinal axis oriented at an angle "A" relative to the tabletop hinge axis 115. Accordingly, when the table apparatus 100 is in the operative position (FIG. 2A; refer also to FIGS. 1A and 3B), the third arm segment 158 of the swing arm 154 of each movable leg 150 extends longitudinally in the horizontal plane along its longitudinal axis oriented at the same first angle "A" relative to the tabletop hinge axis 115 in a manner that mirrors the angle "A" defined by the longitudinal axis of the fixed horizontal arm 138 of the neighboring fixed leg 130. Such a configuration can achieve a desired symmetry and aesthetic appearance for all of the fixed vertical leg portions 132 and the movable vertical leg portions 152, even in optional configurations where the vertical leg portions 132 and 152 all have a non-circular cross-sectional shape (in a horizontal cross-section) as shown by way of example in FIGS. 1A, 2A, and 3B.

Figure 5A:
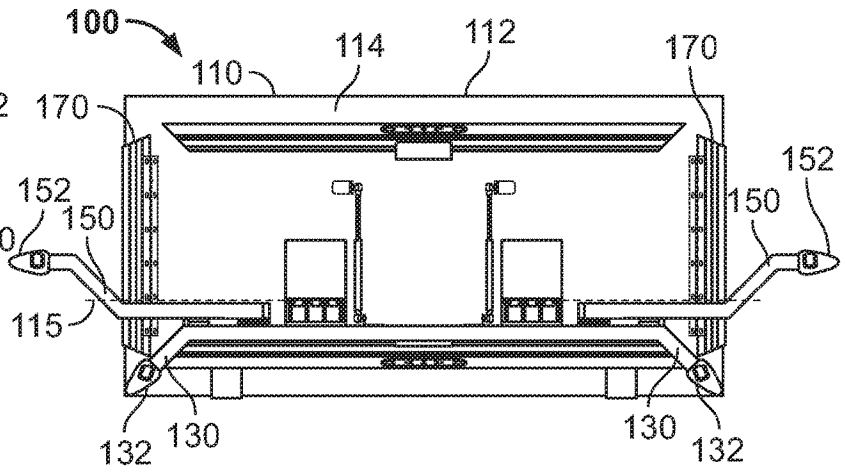
FIG. 5A is a bottom view of the adjustable table apparatus of FIG. 3A, with the movable legs being adjusted to an outer position.
Figure 4A:
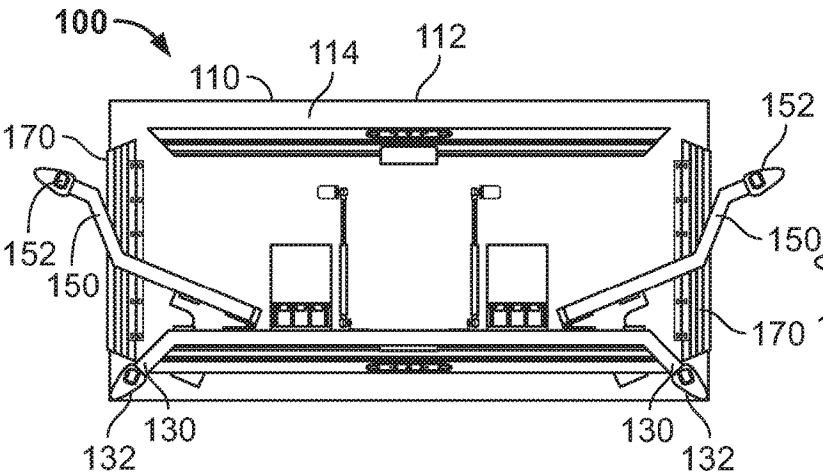
FIG. 4A is a bottom view of the adjustable table apparatus of FIG. 3A, with the movable legs being adjusted to an intermediate position.
Figure 5B:
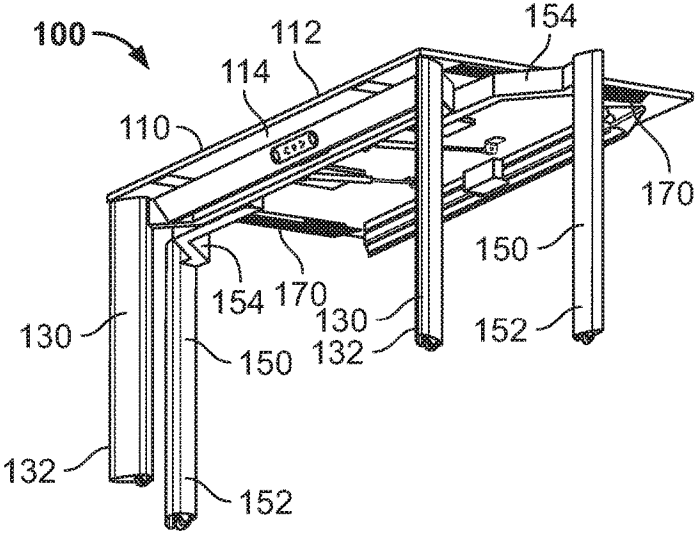
FIG. 5B is a perspective view of the adjustable table apparatus of FIG. 5A.
Figure 4B:
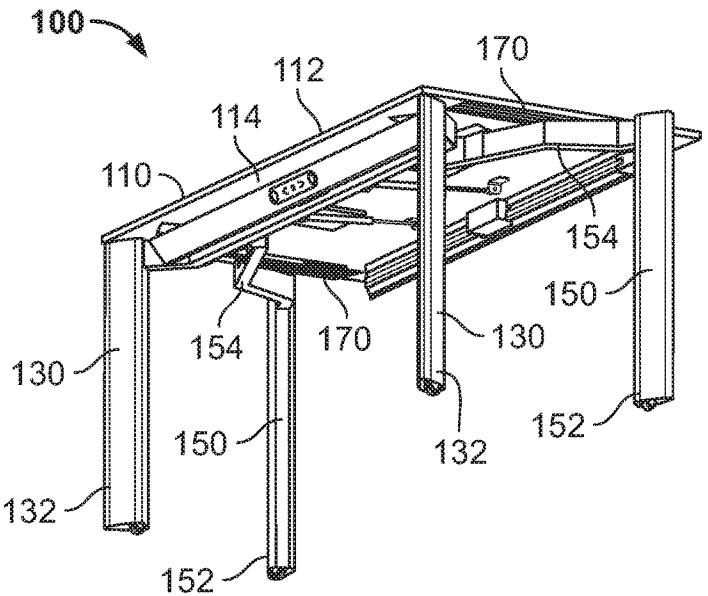
FIG. 4B is a perspective view of the adjustable table apparatus of FIG. 4A.
Figure 7A:
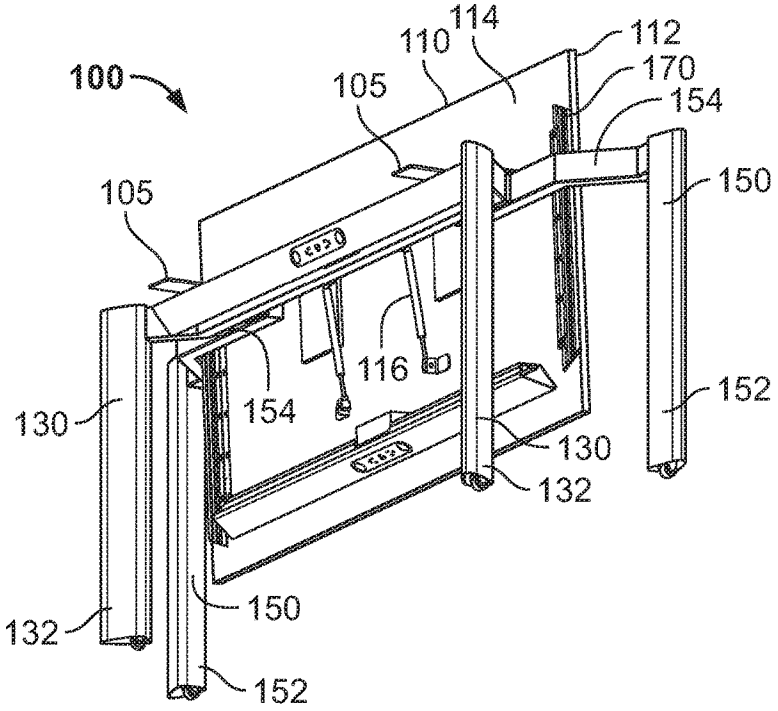
FIG. 7A is a perspective view of the adjustable table apparatus of FIG. 6A, with the tabletop being adjusted to a generally vertical orientation.
Figure 6A:
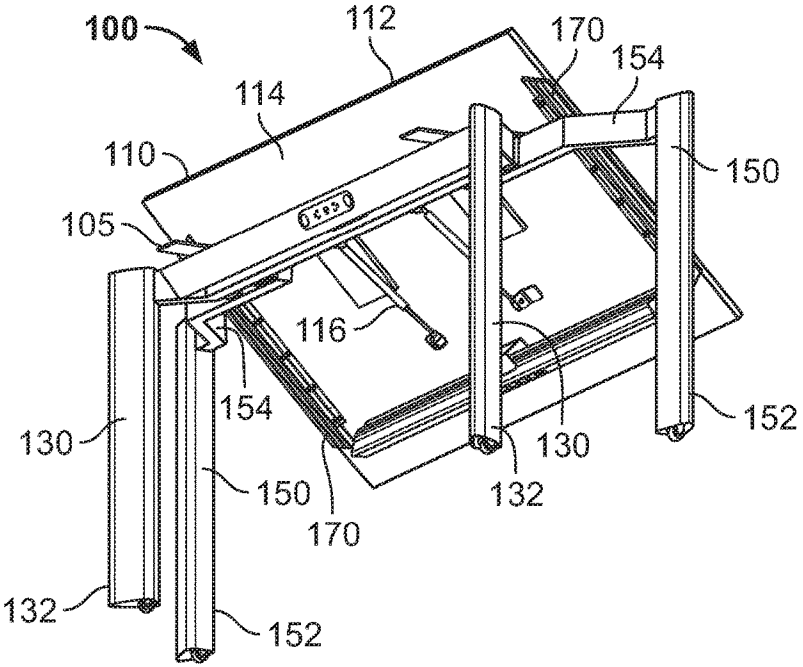
FIG. 6A is a perspective view of the adjustable table apparatus of FIG. 5B, with the tabletop being adjusted to an intermediate orientation.
Figure 7B:
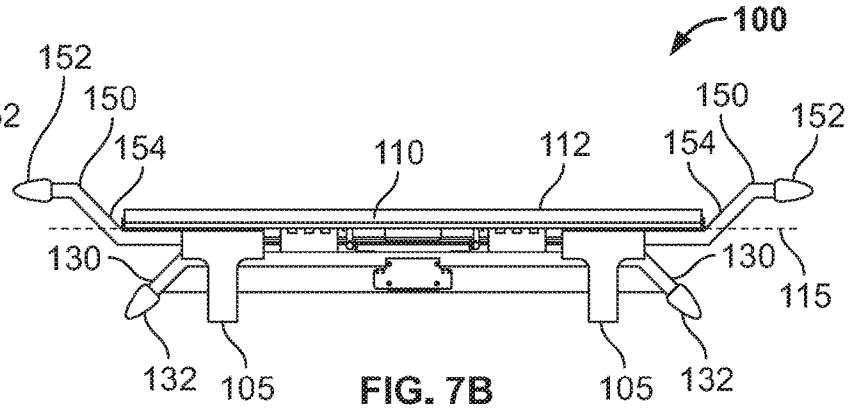
FIG. 7B is a top view of the adjustable table apparatus of FIG. 6A Like reference symbols in the various drawings indicate like elements.
Figure 6B:
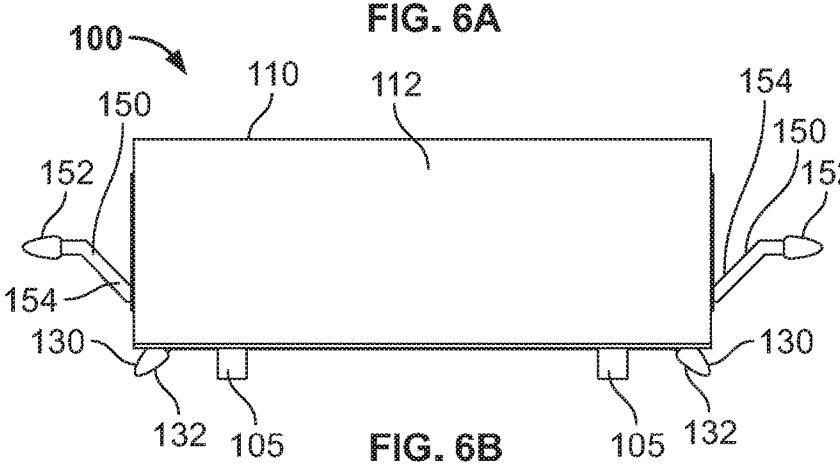
FIG. 6B is a top view of the adjustable table apparatus of FIG. 6A.

Referring now to FIGS. 3A-D, 4A-B, 5A-B, and 6A-B and 7A-B, a method of using the table apparatus 100 can include adjusting the table apparatus 100 from its operative position and is collapsed position (and vice versa). For example, as described above, a single user can individually shift one of the movable legs 150 outwardly away from the other movable leg 150 while the tabletop 110 remains in its horizontal orientation and is supported by three legs (the fixed legs 130 and the other movable leg 150). By pivoting the first movable leg 150, the movable fascia 170 adjacent to the first movable leg 150 can automatically adjust to its collapsed orientation without manual manipulation by the user. FIGS. 4A-B depict each of the movable legs 150 being adjusted outwardly to automatically shift the adjacent movable fascia 170 to the collapsed position, but it should be recognized from the description herein that a single user can opt to adjust each movable leg 150 one at a time. In either option, both movable legs 150 can adjusted outwardly away from one another until both movable legs 150 are arranged as depicted in FIGS. 5A-B. From there, the user can guide the tabletop 110 to pivot away from its horizontal position (refer to FIGS. 5A-B) while optionally under the dampening effect of the gas pistons 116 to provide for a slow, controlled lowering movement of the tabletop 110 (refer to FIGS. 6A-B and 7A-B). As detailed above, the single user may optionally use a single arm/hand to grip the tabletop 110, thereby further controlling the lower of the tabletop 110 from its horizontal orientation to its vertical orientation. After the single user has shifted the movable legs 150 outwardly away from one another and the tabletop 110 is adjusted from its horizontal orientation to its vertical orientation (refer to FIGS. 7A-B), the fixed legs 130 and the movable legs 150 can be advantageously arranged to provide stability and balance for the tabletop 110 while the user is transporting or storing the table apparatus 110. As detailed above, when the table apparatus is in the collapsed position depicted in FIGS. 7A-B, the multiple-bend swing arm 154 (e.g., a dual-bend swing arm 154 in the depicted embodiment) of each movable leg 150 arranges the vertical leg portions 152 to be positioned on one side of the tabletop 110 (e.g., forward of the upper surface 112 in this embodiment) while fixed vertical leg portions 132 of the fixed legs 130 are positioned on an opposite side of the tabletop 110 (e.g., rearward of the lower surface 114 in this embodiment). As such, the center of mass of the tabletop 110 (and in this case, the mass centroid of the table apparatus 100) is positioned between the four legs 130 and 150 while the vertical leg portions 132 and 152 extend to the ground surface to provide stable support during transport and storage. Also, as detailed above, the multiple-bend swing arm 154 of each movable leg 150 can advantageously provide a cavity or space between the vertical leg portions 152 (forward of the upper surface 112 of the tabletop 110 depicted in the FIG. 7B (in the collapsed position)) that is configured to receive other similar table apparatuses 100' (FIGS. 1B-1C) in a nested arrangement, thereby further enhancing the storage benefits achieved by the table apparatus 100. Optionally, each table apparatus 100 and 100' can be equipped with one or more buffers 105, which can serve as spacers to prevent the fixed legs 130 of one table apparatus from contacting (and possibly damaging) an upper surface of a tabletop of an adjacent table apparatus in the nested configuration.

Referring in more detail to FIGS. 3A-D, the movable fascia 170 of the table apparatus 100 can be hingedly mounted to an underside of the tabletop 110 so that such fascia 170 can be individually adjusted between a displayed orientation (FIGS. 3B and 3D) and a collapsed orientation (FIGS. 4A-B and 5A-B). In some embodiments, the displayed orientation of the movable fascia 170 can be angled relative to the lower surface 114 of the tabletop 110 in a manner similar to the fixed orientation of the fixed fascia 180. The orientation of the movable fascia 170 and fixed fascia 180 fascia can be advantageously selected to provide aesthetic appearance suitable, for example, as a formal conference table while also concealing some mechanical components (e.g., the gas springs 116, the hinge assemblies 117, the support beam 130, arm segments 156 and 157 of each movable leg 150, and other hardware) and avoiding interference with users' legs during use. For example, as shown in FIG. 3C, the movable fascia 170 can be oriented to extend from the lower surface 114 of the tabletop 110 at a slanted angle toward the central region of the underside of the tabletop 110 (e.g., toward the swing arm 154) so that the outer face of the movable fascia 170 is oriented at an angle outwardly away from the lower surface 114 of the table and away from the first arm segment 156 of the swing arm 154. It should be understood from the description herein that, in some embodiments, the swing arm 154 of each movable leg may be slightly spaced apart from the lower surface 114 of the tabletop 100 by a clearance gap (such as, for example, a clearance of 2 mm to 10 mm, and preferably about 5 mm), which is not depicted in the view in FIG. 3C without further magnification. The clearance gap may be selected to be slightly greater than a thickness of the movable fascia 170, and as such, the clearance gap can be used to provide sufficient space for the swing arm 154 of the movable leg 150 to slide over the movable fascia 170 while the fascia 170 is in the collapsed orientation (FIGS. 4A-B and 5A-B). In such embodiments, the movable leg 150 can be configured to engaged with a mating surface proximate the ends of the fixed fascia 180 (when in the operative position of FIG. 2A) to thereby mechanically support the tabletop 110 even when the swing arm 154 is spaced apart from the lower surface 114 by the clearance gap.

As shown in FIG. 3D, the movable fascia 170 can be spring biased away from the lower surface 114 of the tabletop 110 and toward the displayed orientation. For example, the movable fascia 170 can include a hinged connection to the lower surface 114 of the tabletop 110 which includes a bias spring 174 mounted along the fascia hinge axis 175.

The bias spring 174 can urge the moveable fascia 170 to return to the displayed orientation (FIGS. 3A-D) when the movable leg 150 is maintained in the position shown in FIG. 3A (where that the swing arm 154 is not swung outwardly to drive the movable fascia toward the collapsed orientation depicted in FIGS. 4A-B and 5A-B). Accordingly, as detailed above, each movable fascia 170 can be adjusted from the displayed orientation to the collapsed orientation in response to a pivoting motion of the adjacent movable leg 150 outwardly away from the other movable leg 150. Likewise, when the adjacent movable leg 150 is pivoted inwardly toward the position shown in FIG. 3A (e.g., motion away from an outer position like that of FIG. 4A toward the position of FIG. 3A), the movable leg 150 no longer compels the movable fascia to its collapsed orientations that the bias spring 174 acts upon the movable fascia 170 to urge the movable fascia 170 toward its displayed orientation.

Accordingly, when the table apparatus 100 is in its operative position, the outwardly facing surfaces of the movable fascia 170 and the fixed fascia 180 are displayed in an orientation below the lower surface 114 of the tabletop 110 in a manner that provides a selected appearance and to at least partially conceal from (upper or side views) other mechanical components of the table apparatus 100 arranged between the fascia 170 and 180 along the underside of the tabletop 110. As depicted in the embodiment of FIGS. 3A-3D, the movable fascia 170 each have a length that is different from the length of the fixed fascia 180, yet in some implementations, the movable fascia 170 and the fixed fascia 180 can have the same profile and angular relationship (relative to the lower surface 114 of the tabletop 110) when arranged in the displayed orientation so as to provide an appearance that is similarly presented along all sides of the table apparatus 100. In some alternative embodiments, the movable fascia 170 need not be hingedly mounted to the lower surface 114 of the tabletop 110. For example, the movable fascia 170 can be magnetically mounted to the lower surface 114 of the tabletop 110 (using magnets inlaid along the bottom surface 114 or along a horizontal panel of the movable fascia) so that the fascia is magnetically retained in the displayed orientation. In such embodiments, the movable fascia 170 can slide away from the displayed orientation in response to movement of the swing arms 154 of the movable legs 150 (or otherwise manually removed by a user) and grasped by the user for repositioning in a storage location.

A number of embodiments have been described. Nevertheless, it will be understood that various modifications may be made without departing from the claim scope herein. Accordingly, other embodiments are within the scope of the following claims.

What is claimed is:

1. An adjustable table apparatus, comprising:

a tabletop including an upper surface and a lower surface and being movable about a tabletop hinge axis such that the upper surface of the tabletop extends in a horizontal orientation when the table apparatus is in an operative position and the upper surface of the tabletop extends in a vertical orientation when the table apparatus is in a collapsed position;

a pair of fixed legs mounted in a fixed position relative to the tabletop hinge axis and configured to extend to a ground surface for supporting the tabletop;

a first movable leg that is pivotable about a first vertical axis relative to both the tabletop and the fixed legs and that includes a first vertical leg portion configured to extend to the ground surface for supporting the tabletop and a first horizontal dual-bend swing arm extending in a horizontal plane from the first vertical axis to the first vertical leg portion, wherein the first horizontal dual-bend swing arm of the first movable leg comprises a first arm segment extending longitudinally in the horizontal plane away from the first vertical axis and toward a first bend in the horizontal plane, a second arm segment extending longitudinally in the horizontal plane away from the first bend and toward a second bend in the horizontal plane, and a third arm segment extending longitudinally in the horizontal plane away from the second bend and toward the first vertical leg portion; and a second movable leg that is pivotable about a second vertical axis relative to both the tabletop and the fixed legs and that includes a second vertical leg portion configured to extend to the ground surface for supporting the tabletop and a second horizontal dual-bend swing arm extending in a horizontal plane from the second vertical axis to the second vertical leg portion.

2. The apparatus of claim 1, further comprising a first movable fascia and a second movable fascia hingedly mounted to the tabletop along the lower surface of the tabletop, the first movable fascia being adjustable from a displayed orientation to a collapsed orientation in response to a first pivoting motion of the first movable leg about the first vertical axis outwardly away from the second movable leg, and the second movable fascia being adjustable from a displayed orientation to a collapsed orientation in response to a second pivoting motion of the second movable leg about the second vertical axis outwardly away from the first movable leg.

3. The apparatus of claim 2, wherein each of the first, second, and third arm segments of the first horizontal dual-bend swing arm are configured to contact the first movable fascia during the first pivoting motion of the first movable leg about the first vertical axis.

4. The apparatus of claim 3, wherein the second horizontal dual-bend swing arm of the second movable leg comprises a first arm segment extending longitudinally in the horizontal plane away from the second vertical axis and toward a first bend in the horizontal plane, a second arm segment extending longitudinally in the horizontal plane away from the first bend and toward a second bend in the horizontal plane, and a third arm segment extending longitudinally in the horizontal plane away from the second bend and toward the second vertical leg portion, wherein each of the first, second, and third arm segments of the second horizontal dual-bend swing arm are configured to contact the second movable fascia during the second pivoting motion of the second movable leg about the second vertical axis.

5. The apparatus of claim 4, wherein the pair of fixed legs each comprise a fixed vertical leg portion, and all of the fixed vertical leg portions, the first vertical leg portion, and the second vertical leg portion have the same non-circular shape in a horizontal cross-section.

6. The apparatus of claim 4, wherein the fixed vertical leg portions of the pair of fixed legs are positioned on a first side of a vertical plane extending through the tabletop hinge axis, and the first and second vertical leg portions of the first and second movable legs remain on a second side of the vertical plane extending through the tabletop hinge axis opposite from the first side both when the table apparatus is in the operative position and when the table apparatus is in the collapsed position.

7. The apparatus of claim 1, wherein a first fixed leg of the pair of fixed legs comprises a fixed horizontal arm extending longitudinally in the horizontal plane to a fixed vertical leg portion, the fixed horizontal arm having a longitudinal axis oriented at a first angle relative to the tabletop hinge axis, wherein when the table apparatus is in the operative position, the third arm segment of the first horizontal dual-bend swing arm extends longitudinally in the horizontal plane and has a longitudinal axis oriented at the same first angle relative to the tabletop hinge axis oppositely from the longitudinal axis of the fixed horizontal arm.

8. The apparatus of claim 1, wherein the pair of fixed legs each comprise a fixed vertical leg portion that is positioned on a first side of the tabletop when the tabletop is in the vertical orientation, and the first and second vertical leg portions of the first and second movable legs are positioned on a second side of the tabletop opposite from the first side of the tabletop when the tabletop is in the vertical orientation.

9. The apparatus of claim 8, further comprising one or more bumpers mounted in a fixed position relative to the pair of fixed legs and extending away from the tabletop when the tabletop is in the vertical orientation, wherein the one or more bumpers are concealed along the lower surface of the tabletop when the tabletop is in the horizontal orientation.

10. An adjustable table apparatus, comprising:

a tabletop including an upper surface and a lower surface and being pivotable about a horizontal axis such that the upper surface of the tabletop extends in a horizontal orientation when the table apparatus is in an operative position and the upper surface of the tabletop extends in a vertical orientation when the table apparatus in a collapsed position;

first and second fixed legs arranged in a fixed position relative to the horizontal axis and configured to support the tabletop over a floor surface;

a first adjustable leg that is movable about a first vertical axis relative to the first and second fixed legs and that includes: a first distal arm segment spaced apart from the first vertical axis and having a first longitudinal axis extending in a horizontal plane, and a first vertical leg portion joined with the first distal arm and configured to extend vertically toward the floor surface, wherein the first longitudinal axis of the first distal arm extends parallel to the horizontal axis when the tabletop is in the vertical orientation; and a second adjustable leg that is movable about a second vertical axis relative to the first and second fixed legs and that includes: a second distal arm segment spaced apart from the second vertical axis and having a second longitudinal axis extending in the horizontal plane, and a second vertical leg portion joined with the second distal arm and configured to extend vertically toward the floor surface, wherein the second longitudinal axis of the second distal arm extends parallel to the horizontal axis when the tabletop is in the vertical orientation.

11. The apparatus of claim 10, further comprising a first movable fascia and a second movable fascia hingedly mounted to the tabletop along the lower surface of the tabletop.

12. The apparatus of claim 11, wherein the first movable fascia is adjustable from a displayed orientation to a collapsed orientation in response to a first pivoting motion of the first adjustable leg about the first vertical axis outwardly away from the second adjustable leg, and the second movable fascia is adjustable from a displayed orientation to a collapsed orientation in response to a second pivoting motion of the second adjustable leg about the second vertical axis outwardly away from the first adjustable leg.

13. The apparatus of claim 12, wherein:

the first adjustable leg comprises: a first proximal arm segment extending longitudinally in the horizontal plane away from the first vertical axis and toward a first bend in the horizontal plane, a first intermediate arm segment extending longitudinally in the horizontal plane away from the first bend and toward a second bend in the horizontal plane, and the first distal arm extending longitudinally in the horizontal plane away from the second bend and toward the first vertical leg portion, wherein each of the first proximal arm segment, the first intermediate arm segment, and the first distal arm of the first adjustable leg are configured to contact the first movable fascia during a first pivoting motion of the first adjustable leg about the first vertical axis; and the second adjustable leg comprises: a second proximal arm segment extending longitudinally in the horizontal plane away from the second vertical axis and toward a first bend in the horizontal plane, a second intermediate arm segment extending longitudinally in the horizontal plane away from the second bend and toward a second bend in the horizontal plane, and the second distal arm extending longitudinally in the horizontal plane away from the second bend and toward the second vertical leg portion, wherein each of the second proximal arm segment, the second intermediate arm segment, and the second distal arm of the second adjustable leg are configured to contact the second movable fascia during a second pivoting motion of the second adjustable leg about the second vertical axis.

14. The apparatus of claim 10, wherein the first and second fixed legs are positioned on a first side of a vertical plane extending through the tabletop hinge axis, and the first and second vertical leg portions of the first and second adjustable legs remain on a second side of the vertical plane extending through the tabletop hinge axis opposite from the first side both when the table apparatus is in the operative position and when the table apparatus is in the collapsed position.

15. The apparatus of claim 14, wherein the first fixed leg comprises a fixed horizontal arm extending longitudinally in the horizontal plane to a fixed vertical leg portion of the first fixed leg, the fixed horizontal arm having a longitudinal axis oriented at a first angle relative to the horizontal axis, wherein when the table apparatus is in the operative position, the first longitudinal axis of the first distal arm of the first adjustable leg is oriented at the same first angle relative to the horizontal axis oppositely from the longitudinal axis of the fixed horizontal arm.

16. The apparatus of claim 10, wherein the first and second fixed legs each comprise a fixed vertical leg portion that is positioned on a first side of a vertical plane defined by the tabletop when the tabletop is in the vertical orientation, and the first and second vertical leg portions of the first and second adjustable legs are positioned on a second side of the vertical plane defined by the tabletop when the tabletop is in the vertical orientation.

17. The apparatus of claim 16, further comprising one or more spacers mounted in a fixed position relative to the first and second fixed legs and extending away from a lower surface of the tabletop when the tabletop is in the vertical orientation, wherein the one or more spacers are concealed along the lower surface of the tabletop when the tabletop is in the horizontal orientation.

18. A system comprising the adjustable table apparatus of claim 10 and at least a second adjustable table apparatus, wherein the adjustable table apparatus of claim 10 is positionable in a nest arrangement with the second adjustable table apparatus when both the adjustable table apparatus of claim 10 and the second adjustable table apparatus are in the collapsed position.

19. A method, comprising:

pivoting a first movable leg of an adjustable table apparatus about a first vertical axis away from a second movable leg while a tabletop of the adjustable table apparatus extends in a horizontal orientation;

in response to said pivoting the first movable leg, shifting a first movable fascia hingedly mounted to the lower surface of the tabletop from a displayed orientation to a collapsed orientation;

pivoting the second movable leg about a second vertical axis away from the first movable leg;

in response to said pivoting the second movable leg, shifting a second movable fascia hingedly mounted to the lower surface of the tabletop from a displayed orientation to a collapsed orientation;

after said shifting the first movable fascia and said shifting the second movable fascia, pivoting the tabletop about a horizontal hinge axis so that an upper surface of the tabletop moves to a vertical orientation and a pair of fixed vertical leg portions of the adjustable table apparatus is positioned on a first side of the tabletop while first and second vertical leg portions of the first and second movable legs are positioned on a second side of the tabletop opposite from the first side of the tabletop.

20. The method of claim 19, further comprising: after said pivoting the tabletop about the horizontal hinge axis so that an upper surface of the tabletop moves to the vertical orientation, positioning the adjustable table apparatus in a nested arrangement with a second adjustable table apparatus.

21. The method of claim 19, wherein the first movable leg comprises: a first proximal arm segment extending longitudinally in a horizontal plane from the first vertical axis and to a first bend in the horizontal plane, a first intermediate arm segment extending longitudinally in the horizontal plane from the first bend and to a second bend in the horizontal plane, and a first distal arm extending longitudinally in the horizontal plane from the second bend and to a first vertical leg portion, and wherein during said pivoting, all of the first distal arm segment, the first intermediate arm segment, and the first proximal arm of the first movable leg sequentially contact the first movable fascia.

* * * * *